United States Patent [19]

Rees et al.

[11] 3,996,698

[45] Dec. 14, 1976

[54] HINGE ACTUATOR

[75] Inventors: Robin Gore Rees, Portmarnock; Patrick Mannix Branigan, Dublin, both of Ireland

[73] Assignee: Institute for Industrial Research and Standards, Dublin, Ireland

[22] Filed: Jan. 8, 1976

[21] Appl. No.: 647,474

[30] Foreign Application Priority Data

Jan. 24, 1975 Ireland ..... 135/75
Apr. 3, 1975 Ireland ..... 748/75

[52] U.S. Cl. ..... 49/324; 49/386; 92/92

[51] Int. Cl.[2] ..... E05F 15/04

[58] Field of Search ..... 92/91, 92, 34, 37, 39; 254/93 R; 49/324, 386

[56] References Cited

UNITED STATES PATENTS

| | | | |
|---|---|---|---|
| 3,047,257 | 7/1962 | Chester | 92/92 X |
| 3,202,061 | 8/1965 | Johnston | 92/37 |
| 3,375,619 | 4/1968 | Hurkamp | 92/92 UX |
| 3,379,411 | 4/1968 | Vanderjagt | 92/92 X |
| 3,958,368 | 5/1976 | Branigan | 49/324 |

*Primary Examiner*—Kenneth Downey
*Attorney, Agent, or Firm*—Ladas, Parry, Von Gehr, Goldsmith & Deschamps

[57] ABSTRACT

This invention relates to means for imparting angular movement to a first member connected to a second member by a hinge in one sense about said hinge pivot axis. The actuator is formed from a flexible substantially inelastic retaining means connected between two anchorage positions on the members and subtending that angle between the two members which is reduced on the first member moving relative to the second member and includes an elongated inflatable conduit of substantially constant surface area which is mounted between the members and the retaining means. The conduit is inflated to press outwards against the retaining means to cause the retaining means to exert a pulling force between the members to impart angular movement to one of said members relative to the other member in this one sense.

12 Claims, 4 Drawing Figures

HINGE ACTUATOR

BACKGROUND OF THE INVENTION

INTRODUCTION

The present invention relates to a fluid pressure powered actuator for imparting angular movement to a first member relative to a second member said first member being connected to the second member by a hinge.

FIELD OF THE INVENTION

The term "members connected together by a hinge" used in this Specification includes not only a door or other closure member mounted in a frame or opening on a common form of hinge, that is to say a pair of rigid plates or the like pivotally connected by a hinge pin, but also includes any two hingedly connected members, that is to say any two members connected together by any jointing means, which allows relative angular motion about a pivot axis between the members similar to the relative angular motion that would be achieved if the members were connected by a more conventional construction.

It is known to provide a fluid pressure powered actuator for imparting relative angular movement between two members connected by a hinge in which the two members are arranged in a fixed angular relation to each other to form a substantially "V" shaped trough. At least one flexible sack or pouch of wedge shaped cross-section is disposed between the members and inflation of the pouch causes the members to be forced apart. For example, U.S. Pat. No. 3,495,502 (D. E. Bousso) described a device for converting fluid pressure to angular mechanical movement or vice versa, the device comprising at least one pouch of flexible material arranged to contain fluid under pressure and connected to hinge means arranged to restrain radial movement of the pouch relative to the axis of the hinge means.

U.S. Pat. No. 3,202,061 (L. B. Johnston) describes and claims a fluid actuator displacement and positioning system comprising; a pair of substantially rigid elongated members in juxtaposition; guide means to direct relative movement of the members; a closed chamber comprising a plurality of cells having flexible walls extending between and attached to one of the said members, and free of the other member, said flexible wall being so related to said members as to exert to force thereon when said chamber is subjected to fluid pressure; and the necessary means to introduce a fluid under pressure into the chamber.

These types of fluid pressure powered actuators may be described as "push" type fluid pressure powered actuators. There are, however, certain disadvantages in these known constructions of "push" type fluid pressure powered actuators in that they are relatively expensive to produce. Further they require a considerable amount of head room to install and indeed, are rather difficult to install in a confined space. Very often they require mechanical linkages to transmit the torque imparted or to magnify the displacement of the members. Further the flexible sack or pouch is often of rather large cross-sectional area. Additionally, these "push" type fluid pressure powered actuators impart substantially constant torque throughout their entire stroke and very often require a slave cylinder or buffer at the end of the stroke to provide adequate cushioning. Further with these "push" type fluid pressure powered actuators it has been noted that a considerable pressure is placed on the hinge between the two members, which thus necessitates the provision of fairly substantial and robust hinges.

The principal problems of the "push" type fluid pressure powered actuators were overcome by the copending U.S. patent application Ser. No. 508,952 filed in the name of one of the present Applicants namely, Patrik, Mannix Branigan.

OBJECTS

The present invention is directed towards providing an improved construction of "pull" type fluid pressure powered actuator for imparting relative angular movement between two members connected together by a hinge. Another object of the invention is to provide a fluid pressure powered actuator with a high initial starting torque and a low finishing torque thus giving a natural cushioning effect.

A further object of the invention is to provide a fluid pressure powered actuator that can be readily and cheaply manufactured.

SUMMARY OF THE INVENTION

This invention provides in combination, a first member, a second member, a hinge connecting the first member to the second member and defining a hinge pivot axis for the members and a fluid pressure powered actuator for imparting angular movement to the first member relative to the second member in one sense about said axis, the actuator comprising:

mounting means on each member defining an anchorage position;

a flexible substantially inelastic retaining means connected between the two anchorage positions and subtending that angle between the two members which is reduced on the first member moving relative to the second member about said axis in said one sense;

an elongated inflatable conduit of substantially constant surface area, the conduit having its longitudinal axis substantially parallel to the hinge pivot axis and being disposed between the members and the retaining means; and means for inflating the conduit to press outwards against the retaining means to cause the retaining means to exert a pulling force between the members to impart angular movement to said first member relative to said second member in said one sense about said axis.

A further embodiment of the invention provides a fluid pressure powered actuator for opening or closing a door mounted by a hinge on a door frame comprising:

mounting means on the door frame and the door defining an anchorage position on each a flexible substantially inelastic retaining means connected between the two anchorage positions and subtending that angle between the door and the door frame which is reduced on operation of the actuator;

an elongated inflatable conduit of substantially constant surface area, the conduit having its longitudinal axis substantially parallel to the hinge pivot axis and being disposed between the door, door post and retaining means; and means for inflating the conduit to press outwards against the retaining means to cause the retaining means to exert a pulling force between the door and door frame to impart angular movement to the door relative to the frame to reduce said angle; and means for returning the door to its original position on release of the fluid pressure.

The main advantages of the present invention are that readily obtainable materials are used thus reducing manufacturing costs. A further advantage of the invention is that the torque displacement characteristics of the fluid pressure powered actuator according to the invention are particularly suitable for closure members there being a high initial torque and a low finishing torque.

It has also been found that the present invention lends itself readily to installation on existing doors and that in view of the small cross-sectional area of the conduit that may be used it can be installed in very confined spaces along the length of the door post. A still further advantage of the fluid pressure powered actuator according to the present invention is that it has a very high torque to cross-sectional area ratio.

The above and other objects and advantages of this invention will become apparent from the following detailed description in connection with the accompanying drawings.

Figure 1:
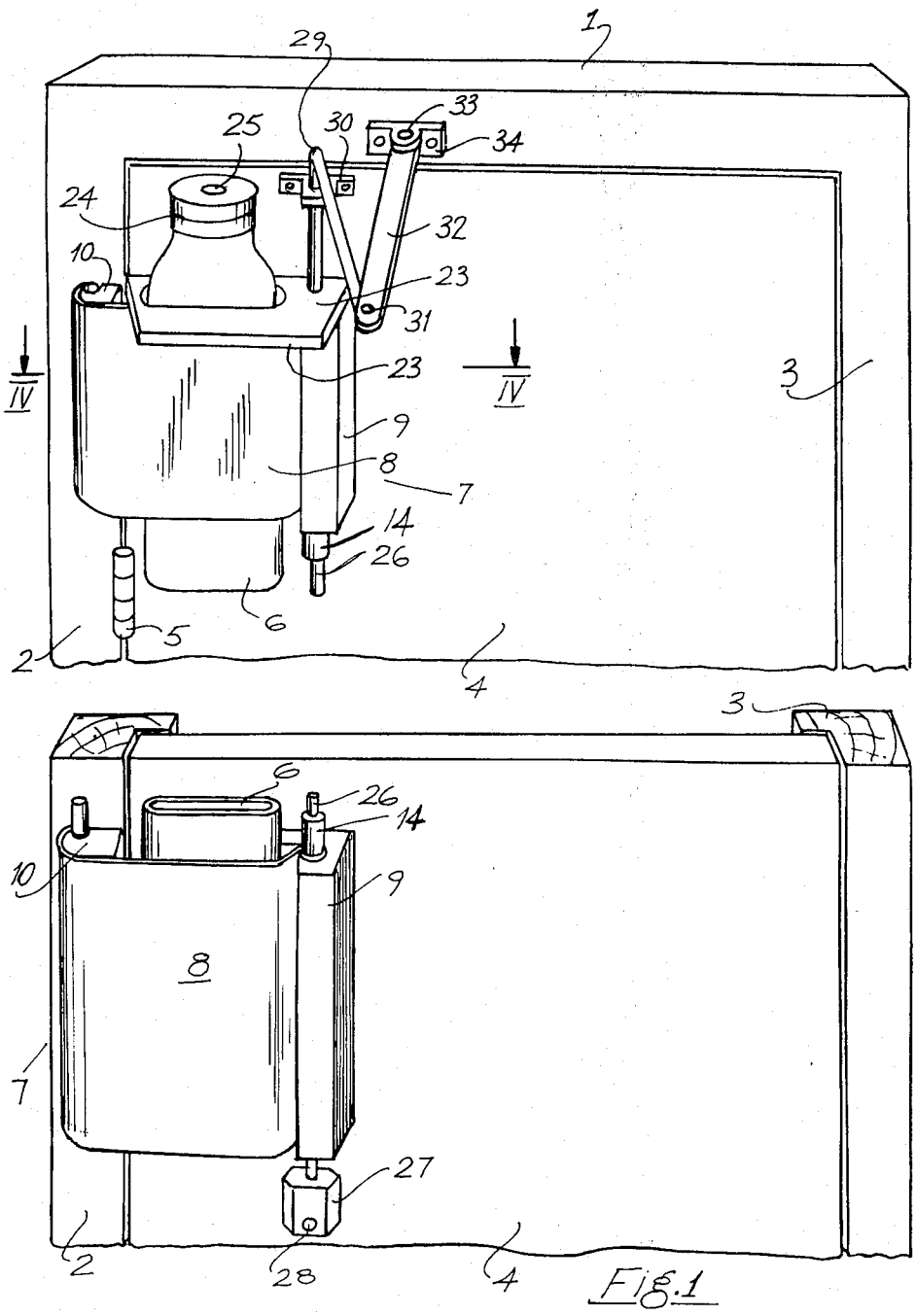
FIG. 1 is a partial cut-away perspective view of a door mounted in a door frame and the hinge actuator according to the invention, the door being shown in the closed position.

Referring to the drawings there is illustrated a first member namely a door frame formed from an upper transverse member 1, an inner door post 2 and an outer door post 3.

A second member in this embodiment a door 4 is mounted on a number of hinges 5 only one of which is illustrated. The hinges 5 define a pivot axis P for the door 4 within the door frame. A conduit 6 is mounted against the door post 2 and the door 4 by a flexible inelastic retaining means indicated generally by the reference numeral 7.

The retaining means 7 comprises a membrane 8 of reinforced fabric connected to the door 4 by a mounting plate 9 and to the inner door post 2 by a mounting plate 10. The mounting plates 9 and 10 define anchorage positions for the retaining means 7 on the two members, namely, the inner door post 2 and the door 4.

Figure 4:
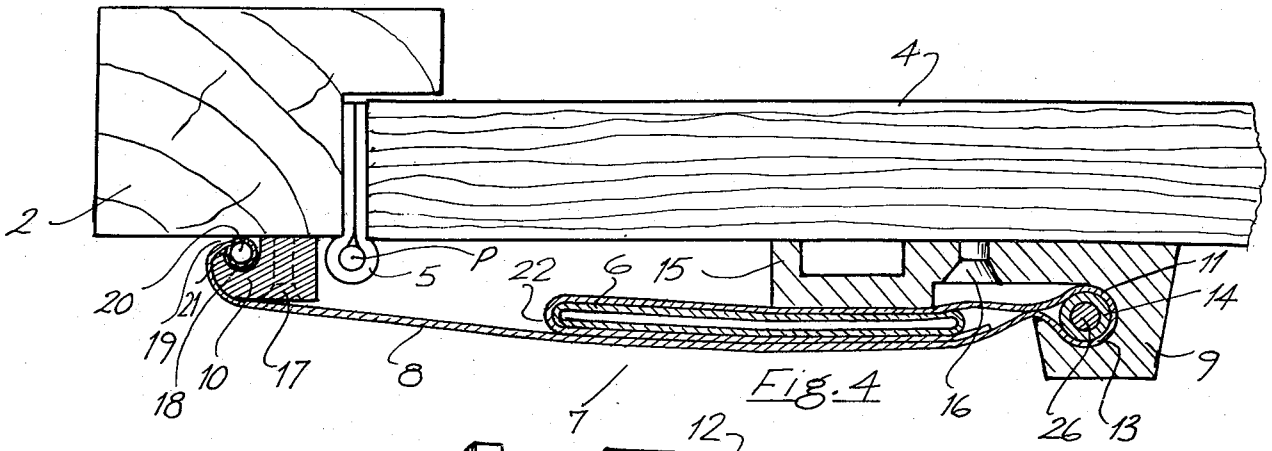
FIG. 4 is a typical horizontal cross-sectional view in the direction of the arrows IV—IV of FIG. 1.
Figure 3:
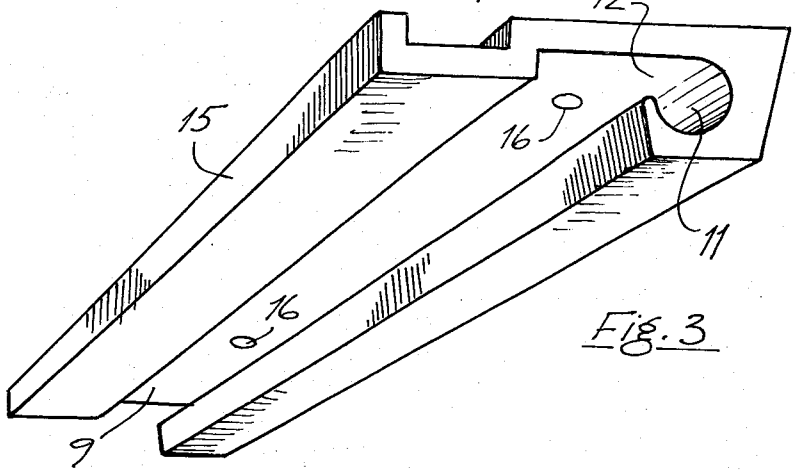
FIG. 3 is a perspective view of a mounting plate according to the invention.

Referring to FIGS. 3 and 4 the mounting plate 9 includes a hole 11 and an elongated entrance slot 12 for reception of an edge pocket 13, formed in the membrane 8 by folding the embrance 8 back on itself and securing it, for example by heat sealing or stitching. The edge pocket 13 is retained in the hole 11 by a tubular bar 14. The mounting plate 9 incorporates an integral packing piece 15 and is secured to the door 4 by means of screws, not shown, which engage holes 16.

The mounting plate 10 is of somewhat similar construction to the mounting plate 9 and when mounted on the inner door post 2 by means of screws, not shown, through holes 17 forms a hole 18 and an entrance slot 19. The membrane 8 is secured in the hole 18 by a bar 20 which engages a further edge pocket 21 in the membrane 8.

The membrane 8 is folded over to form an additional longitudinal pocket 22, into which the conduit 6 is inserted. The pocket 22 maintains the conduit 6 with its longitudinal axis offset from the hinge axis P. In the embodiment illustrated, the pocket 22 is so arranged that the conduit 6 overlaps one member only namely the door 4 the degree of overlap may be varied. It will also be noted that the packing piece 15 maintains the pocket 22 and hence the conduit 6 in spaced relation with the door 4. Thus the two anchorage positions of the membrane 8 and the hinge pivot axis P together forms the apices of a triangle in a plane perpendicular to the hinge pivot axis P. The conduit 6 projects through a plate 23 mounted on the door 4 and is sealed by an end stop 24 which is connected by an inlet 25 to an air inlet pipe not shown. The conduit 6 is sealed at the other end, the sealing arrangement is not shown.

The conduit 6 is an inflatable flexible conduit of substantially constant surface area, that is to say, on inflation the surface area does not expand appreciably. A torsion bar 26 is provided and is mounted within the tubular bar 14. The torsion bar 26 is provided with a conventional pre-tension device 27 mounted by a screw 28 on the door 4. The torsion bar 26 is cranked adjacent its upper end at 29 and is supported against the door 4 by a support block 30. The torsion bar 26 is connected by means of a pivot pin 31 to a swivel linkage 32 mounted by means of a further pin 33 on a support member 34: this assembly forms a toggle mechanism at the top of the door 4.

Figure 2:
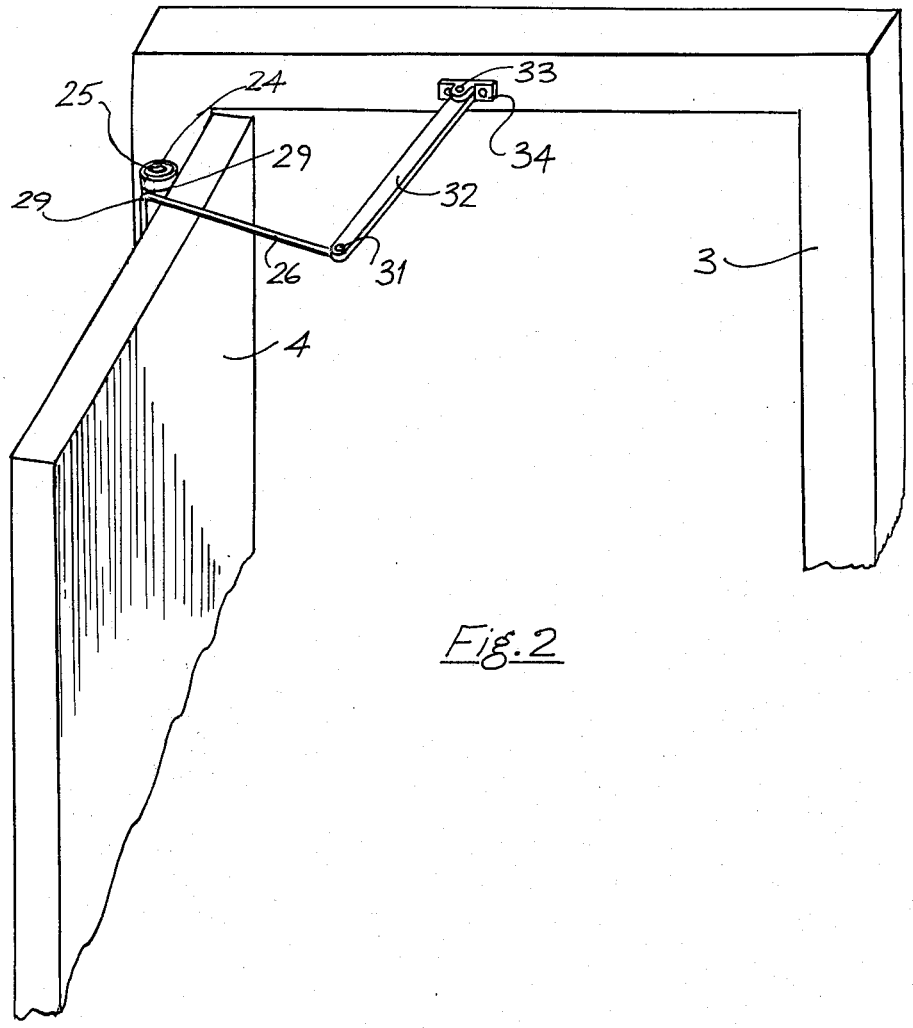
FIG. 2 is a view of portion of FIG. 1 showing the door in the open position.

In use, air under pressure is introduced from an air pressure source through the inlet 25 to inflate the conduit 6. This causes the conduit 6 to assume a more cylindrical shape as illustrated in FIG. 2, thus forcing the membrane 8 away from the hinges 5 and exerting an outward force on the membrane 8 which induces a transverse tension in the membrane 8 which pulls between the anchorage positions, that is to say between the mounting plates 9 and 10, causing the door 4 to pivot on the inner door post 2. It will be noted that the corresponding inward reaction of the conduit 6 is now taken up by the door 4. In view of the lateral displacement of the conduit 6 by the packing piece 15 the direction of the initial pull on the door 4 is at a more efficient angle than if the membrane 8 lay parallel to the inner door post 2 and the door 4. To close the door 4 air is exhausted out of the conduit 6 and the torsion bar 26 operates in conventional manner.

It will be appreciated that while in the embodiment described above reference is made to a hinge actuator for pivoting a door on a door post the invention will be equally applicable to any two members connected together by a hinge.

Further in the embodiment above the retaining means incorporates a membrane of reinforced fabric it will be appreciated that the membrane can be formed from a thin sheet of spring steel, flexible wire mesh or other suitable means as will be readily apparent to those skilled in the art.

It has been found desirable, in practice, for the longitudinal axis of the conduit to be offset laterally from the hinge pivot axis.

We claim:

1. In combination, a first member, a second member, a hinge connecting the first member to the second member and defining a hinge pivot axis for the members and a fluid pressure powered actuator for imparting angular movement to the first member relative to the second member in one sense about said axis, the actuator comprising:

mounting means on each member defining an anchorage position;

a flexible substantially inelastic retaining means connected between the two anchorage positions and subtending that angle between the two members which is reduced on the first member moving relative to the second member about said axis in said one sense;

an elongated inflatable conduit of substantially constant surface area, the conduit having its longitudinal axis substantially parallel to the hinge pivot axis and being disposed between the members and the retaining means; and means for inflating the conduit to press outwards against the retaining means to cause the retaining means to exert a pulling force between the members to impart angular movement to said first member relative to said second member in said one sense about said axis.

2. A combination as recited in claim 1 in which the longitudinal conduit of the axis is offset laterally from the hinge axis to overlap one member more than the other.

3. A combination as recited in claim 2 in which a longitudinal pocket is provided on the retaining means to maintain said offset.

4. A combination as recited in claim 1 in which the conduit is so offset as to overlap one member only.

5. A combination as recited in claim 4 in which a longitudinal pocket is provided on the retaining means to embrace the conduit to maintain said offset.

6. A combination as recited in claim 1 in which the mounting means is so arranged that the two anchorage positions and a hinge pivot axis together form the apices of a triangle in a plane perpendicular to the hinge pivot axis.

7. A combination as recited in claim 1 in which the retaining means comprises a flexible sheet of substantially inelastic material having an elongated pocket along two parallel edges thereof and in which each mounting means includes a mounting plate, each mounting plate incorporating a cylindrical hole having an elongated entrance slot for reception of a side pocket, and a bar for engagement in the pocket to retain the pocket in the hole and thus form an anchorage position.

8. A hinge actuator as claimed in claim 7 in which a longitudinal pocket is provided on the retaining means to embrace the conduit to maintain the longitudinal axis of the conduit offset from the hinge axis.

9. A fluid pressure powered actuator for opening or closing a door mounted by a hinge on a door frame comprising:

mounting means on the door frame and the door defining an anchorage position on each a flexible substantially inelastic retaining means connected between the two anchorage positions and subtending that angle between the door and the door frame which is reduced on operation of the actuator;

an elongated inflatable conduit of substantially constant surface area, the conduit having its longitudinal axis substantially parallel to the hinge pivot axis and being disposed between the door, door post and retaining means; and means for inflating the conduit to press outwards against the retaining means to cause the retaining means to exert a pulling force between the door and door frame to impart angular movement to the door relative to the frame to reduce said angle; and means for returning the door to its original position on release of the fluid pressure.

10. A hinge actuator as recited in claim 9 in which the retaining means comprises a flexible sheet of substantially inelastic material having an elongated edge pocket along two parallel edges thereof and in which each mounting means includes a mounting plate incorporating a cylindrical hole having an elongated entrance slot for reception of a pocket, and a bar for engagement in the pocket to retain the pocket in the hole and thus form an anchorage position.

11. A hinge actuator as recited in claim 10 in which an additional longitudinal pocket is provided on the retaining means to embrace the conduit to maintain the longitudinal axis of the conduit offset laterally from the hinge axis so as to overlap the door only.

12. A hinge actuator as recited in claim 11 in which the means for returning the door to its original position comprises a torsion bar mounted between the door and the door frames, the torsion bar projecting through a tube forming a bar in one of the pockets.

* * * * *